US006257140B1

(12) United States Patent
Palmatier et al.

(10) Patent No.: US 6,257,140 B1
(45) Date of Patent: Jul. 10, 2001

(54) CONTINUOUS PROCESS GAPLESS TUBULAR LITHOGRAPHIC PRINTING BLANKET

(75) Inventors: Roland Thomas Palmatier, Durham; James Brian Vrotacoe, Rochester, both of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/472,337

(22) Filed: Dec. 27, 1999

(51) Int. Cl.[7] ..... B41N 6/00
(52) U.S. Cl. ..... 101/401.1; 101/376; 428/909
(58) Field of Search ..... 101/375, 376, 101/401.1, 217; 428/909

(56) References Cited

U.S. PATENT DOCUMENTS

| | | | | |
|---|---|---|---|---|
| 5,245,923 | * | 9/1993 | Vrotacoe | 101/375 |
| 5,304,267 | | 4/1994 | Vrotacoe et al. | 156/86 |
| 5,316,798 | * | 5/1994 | Tittgemeyer | 427/409 |
| 5,323,702 | | 6/1994 | Vrotacoe et al. | 101/217 |
| 5,347,927 | * | 9/1994 | Berna et al. | 101/401.1 |
| 5,352,507 | * | 10/1994 | Bresson et al. | 428/909 |
| 5,429,048 | | 7/1995 | Gaffney et al. | 101/217 |
| 5,440,981 | | 8/1995 | Vrotacoe et al. | 101/542 |
| 5,456,171 | * | 10/1995 | Blava et al. | 428/909 |
| 5,553,541 | | 9/1996 | Vrotacoe et al. | 101/217 |
| 5,768,990 | | 6/1998 | Vrotacoe et al. | 101/217 |
| 5,860,360 | * | 1/1999 | Lane, III et al. | 101/376 |
| 5,893,799 | * | 11/1999 | Lane, III et al. | 101/375 |
| 5,974,973 | * | 2/1999 | Tittgemeyer | 101/375 |
| 6,019,042 | * | 2/2000 | Battl et al. | 101/376 |
| 6,148,725 | * | 11/2000 | Knauer et al. | 101/217 |
| 6,182,568 | * | 2/2001 | Ogita et al. | 101/376 |

FOREIGN PATENT DOCUMENTS 197 20 549 5/1997 (DE) .

* cited by examiner

*Primary Examiner*—Eugene Eickholt
(74) *Attorney, Agent, or Firm*—Davidson, Davidson & Kappel, LLC

(57) ABSTRACT

A continuous process for manufacturing a gapless tubular printing blanket comprising the steps of continuously forming a tubular sleeve in a sleeve forming station; continuously moving the tubular sleeve axially from the sleeve forming station through a print layer forming station and continuously applying a print layer over said tubular sleeve as it passes through said further print layer forming station to form a gapless tubular printing blanket of indeterminate length. In accordance with one embodiment, the tubular sleeve is rotated as it moves axially from the sleeve forming station through print layer forming station. In accordance with another embodiment the the tubular sleeve is not rotated (i.e. it remains rotationally fixed) as it moves axially from the sleeve forming station through print layer forming station.

20 Claims, 11 Drawing Sheets

CONTINUOUS PROCESS GAPLESS TUBULAR LITHOGRAPHIC PRINTING BLANKET

FIELD OF THE INVENTION

The present invention relates to the offset lithographic printing blankets, and more particularly, to gapless tubular offset lithographic printing blankets and methods for manufacturing the same.

BACKGROUND OF THE INVENTION

A web offset printing press typically includes a plate cylinder, a blanket cylinder and an impression cylinder supported for rotation in the press. The plate cylinder carries a printing plate having a rigid surface defining an image to be printed. The blanket cylinder carries a printing blanket having a flexible surface which contacts the printing plate at a nip between the plate cylinder and the blanket cylinder. A web to be printed moves through a nip between the blanket cylinder and the impression cylinder. Ink is applied to the surface of the printing plate on the plate cylinder. An inked image is picked up by the printing blanket at the nip between the blanket cylinder and the plate cylinder, and is transferred from the printing blanket to the web at the nip between the blanket cylinder and the impression cylinder. The impression cylinder can be another blanket cylinder for printing on the opposite side of the web.

A conventional printing blanket is manufactured as a flat sheet. Such a printing blanket is mounted on a blanket cylinder by wrapping the sheet around the blanket cylinder and by attaching the opposite ends of the sheet to the blanket cylinder in an axially extending gap in the blanket cylinder. The adjoining opposite ends of the sheet define a gap extending axially along the length of the printing blanket. The gap moves through the nip between the blanket cylinder and the plate cylinder, and also moves through the nip between the blanket cylinder and the impression cylinder, each time the blanket cylinder rotates.

When the leading and trailing edges of the gap at the printing blanket move through the nip between the blanket cylinder and an adjacent cylinder, pressure between the blanket cylinder and the adjacent cylinder is relieved and established, respectively. The repeated relieving and establishing of pressure at the gap causes vibrations and shock loads in the cylinders and throughout the printing press. Such vibrations and shock loads detrimentally affect print quality. For example, at the time that the gap relieves and establishes pressure at the nip between the blanket cylinder and the plate cylinder, printing may be taking place on the web moving through the nip between the blanket cylinder and the impression cylinder. Any movement of the blanket cylinder or the printing blanket caused by the relieving and establishing of pressure at that time can smear the image which is transferred from the printing blanket to the web. Likewise, when the gap in the printing blanket moves through the nip between the blanket cylinder and the impression cylinder, an image being picked up from the printing plate by the printing blanket at the other nip can be smeared. The result of the vibrations and shock loads caused by the gap in the printing blanket has been an undesirably low limit to the speed at which printing presses can be run with acceptable print quality.

In response to these deficiencies in conventional flat printing blankets, gapless tubular printing blankets were developed by the assignee of the present invention. These gapless tubular printing blankets are described, for example, in U.S. Pat. Nos. 5,768,990, 5,553,541, 5,440,981, 5,429,048, 5,323,702, and 5,304,267.

In this regard, U.S. Pat. No. 5,304,267 is directed to a method of manufacturing a gapless tubular printing blanket. The specification of this patent describes a preferred method of manufacturing a gapless tubular printing blanket as "coating a compressible thread with a mixture of rubber cement and microspheres, and wrapping the coated thread in a helix around the cylindrical sleeve" to form a compressible layer; "coating an inextensible thread with a rubber cement that does not contain microspheres, and wrapping the coated thread in a helix around the underlying compressible layer" to form an inextensible layer, and "wrapping an unvulcanized elastomer over the inextensible layer, securing it with tape" and vulcanizing "the taped structure . . . so that a continuous seamless tubular form is taken by the overlying layers of elastomeric material. " Additional methods of manufacture are also described, including the manufacture of a gapless tubular printing blanket having a circumferentially inextensible sublayer comprising a continuous piece of plastic film extending in a spiral through the elastomeric material of an inextensible layer and around a compressible layer. The plastic film preferably has a width approximately equal to the length of the tubular printing blanket, and a thickness of only 0.001 inches so that the narrow seam defined by the 0.001 inch wide edge of the uppermost layer thereof will not disrupt the smooth, continuous cylindrical contour of an overlying printing layer.

DE 197 20 549 A1 purports to describe a method for manufacturing a cylinder carrier by winding of a continuous strip onto a supporting mandrel surface. The strip is unwound from a spool which is mounted so that it can pivot so that the strip winding angle is self adjustable. Strip tension is maintained during the winding process. Preliminary conditioning treatment and coating of the strip with an adhesive takes place between unwinding and winding of the strip. The preliminary treatment stations are mounted on a support wall which is installed to that it can pivot relative to the cylinder surface. The cylindrical carrier shell is coated with an integral layer of plastic material. The carrier shell is shown as having a fixed length.

SUMMARY OF THE INVENTION

The methods for manufacturing gapless tubular printing blankets described above suffer from the deficiency that they produce blankets in batch mode (i.e. one at a time) with a fixed axial length. Batch mode production increases production costs, increases production time, and results in batch to batch variability in the blankets produced.

In accordance with the present invention, gapless tubular printing blankets are produced continuously and cut to length as desired. In accordance with an embodiment of the present invention, a continuous process for manufacturing a gapless tubular printing blanket comprising the steps of continuously forming a tubular sleeve in a sleeve forming station, moving the tubular sleeve axially from the sleeve forming station through a print layer forming station, and continuously applying one or more layers including at least a print layer over said tubular sleeve as it passes through said print layer forming station to form a gapless tubular printing blanket of indeterminate length. In this regard, the sleeve and print layer are "continuously" formed in that the sleeve forming station continues to form an additional portion of the sleeve while the print layer forming station applies the print layer to the previously formed portion of the sleeve. It is preferable, but not necessary, that the movement of the sleeve be continuous.

In accordance with one embodiment of the present invention, hereinafter referred to as the rotating and translating embodiment, the tubular sleeve is rotated as it moves axially from the sleeve forming station through the print layer forming station. In accordance with another embodiment of the present invention, hereinafter referred to as the non-rotating and translating embodiment, the tubular sleeve is not rotated (i.e. it remains rotationally fixed) as it moves axially from the sleeve forming station through the print layer forming station.

In accordance with the present invention, the continuous process gapless tubular printing blanket includes a sleeve and one or more layers of material over the sleeve. In the preferred embodiment of the present invention, the blanket includes a metal sleeve over which is applied a compressible layer, a reinforcing layer, and a print layer.

In accordance with the rotating and translating embodiment, the sleeve is preferably manufactured by winding metal strips around a rotating and translating body, and in accordance with the non-rotating and translating embodiment, the sleeve is preferably manufactured by passing a sheet of metal through a conical former and around a translating body, where the ends of the sheet of metal are joined together.

In accordance with the rotating and translating embodiment, the one or more layers may be applied in a variety of ways. In accordance with one embodiment, two partially overlapping strips of reinforcing material are wound around the sleeve. A first, inner strip, has a inner surface adjacent to said sleeve, the inner surface having a strip of elastomeric compressible material bonded thereto. The second, outer strip, has an outer surface having a strip of elastomeric print transferring material bonded thereto. The first and second overlapping strips are preferably bonded to each other with an adhesive. In this manner, as the sleeve rotates and moves translationally, the first and second overlapping strips are wound around the sleeve, and a compressible, reinforcing, and print layer is thereby applied to the sleeve. Preferably, the sleeve continues to move axially and rotatingly through a curing station where it is cured, and then to a grinding station where the print layer is ground smooth. As the sleeve is continuously prepared, it can be cut to any desired length after it is cured and ground.

In accordance with another embodiment, the compressible layer, the reinforcing layer, and/or the print layer may be formed in separate forming stations using a coating device such as a stepped cement coating device, a tapered cement coating device, or a cross-head extruder. In other embodiments, the print layer is formed using a coating device, while the remaining layers are formed by winding two partially overlapping strips of reinforcing material around the sleeve, wherein the inner strip has an elastomeric compressible material bonded to its inner surface. In yet another embodiment, the compressible layer is formed using a coating device, while the remaining layers are formed by winding two partially overlapping strips of reinforcing material around the sleeve, wherein the outer strip has an elastomeric print transferring material bonded to its outer surface. In each case, the partially overlapping strips of reinforcing material are preferably bonded to each other with an adhesive In accordance with the non-rotating and translating embodiment, the one or more layers also may be applied in a variety of ways. For example, some or all of the the compressible layer, the reinforcing layer, and/or the print layer may be formed with cross-head extruders or conical formers. Preferably, the sleeve then continues to move axially through a curing station where it is cured, and then to a grinding station where the print layer is ground smooth. As the sleeve is continuously prepared, it can be cut to any desired length after it is cured and ground.

In accordance with another non-rotating and translating embodiment, the compressible, reinforcing and print layers may be formed by winding first and second partially overlapping strips of reinforcing material around the rotationally fixed sleeve. A first, inner strip, has a inner surface adjacent said sleeve, the inner surface having a strip of elastomeric compressible material bonded thereto. The second, outer strip, has an outer surface having a strip of elastomeric print transferring material bonded thereto. The first and second partially overlapping strips are bonded to each other with an adhesive. In this manner, as the first and second partially overlapping strips are wound around the non-rotating, translating sleeve, a compressible, reinforcing, and print layer is applied to the sleeve.

In other embodiments, the print layer is formed using a conical former or a cross-head extruder, while the remaining layers are formed by winding two partially overlapping strips of reinforcing material around the sleeve, wherein the inner strip has an elastomeric compressible material bonded to its inner surface. In yet another embodiment, the compressible layer is formed using a conical former or a cross-head extruder, while the remaining layers are formed by winding two partially overlapping strips of reinforcing material around the sleeve, wherein the outer strip has an elastomeric print transferring material bonded to its outer surface. In each case, the partially overlapping strips are preferably bonded to each other with an adhesive.

DETAILED DESCRIPTION OF THE PREFERRED EMBODIMENTS

Figure 1:
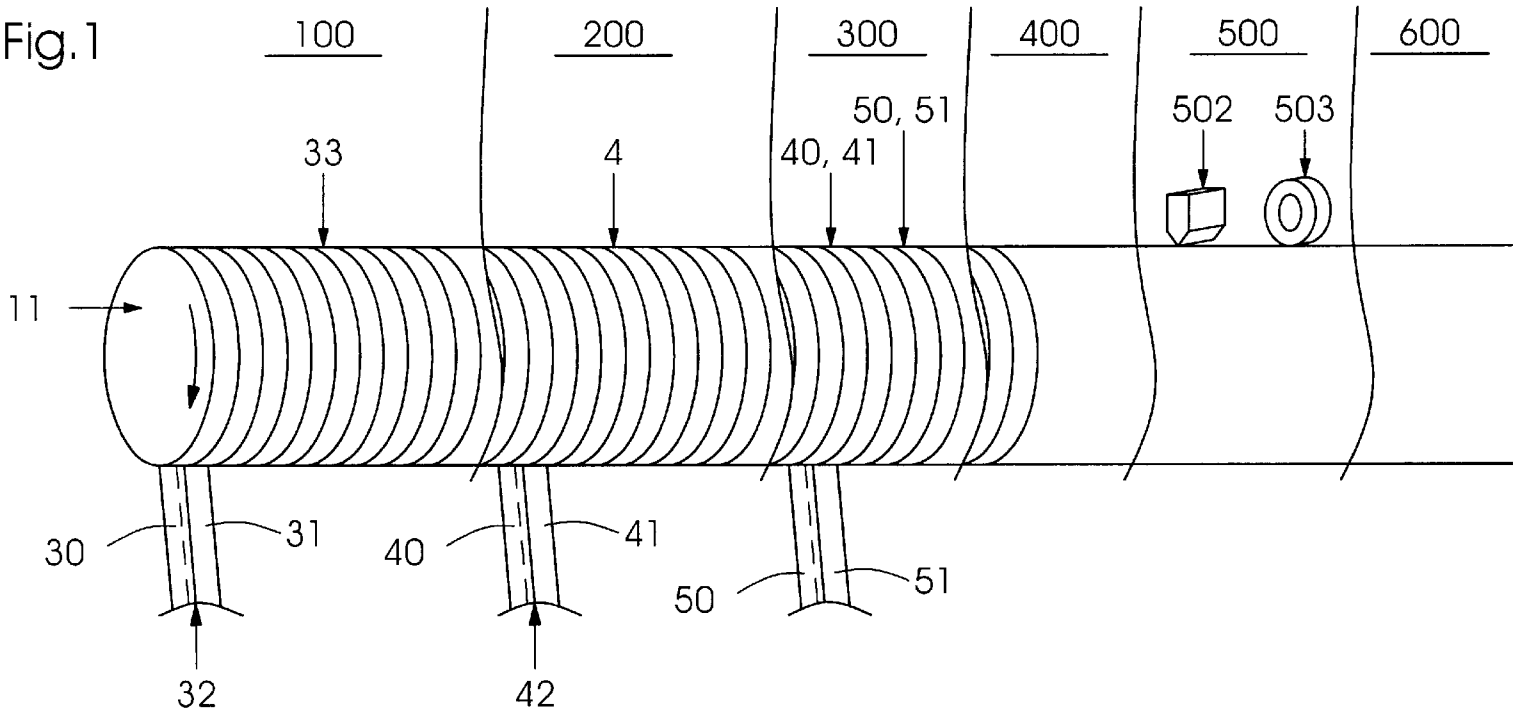
FIG. 1 shows a rotating and translating process for preparing a continuous gapless tubular printing blanket in accordance with an embodiment of the present invention utilizing a pair of overlapping MYLAR® strips, with a first, inner strip having an inner surface coated with a compressible layer and with a second, outer strip having an outer surface coated with a print layer to provide a compressible layer, a reinforcing layer and a printing layer.
Figure 1A:
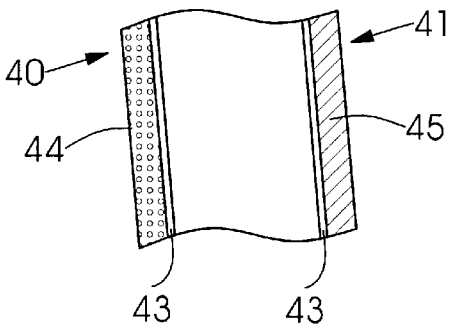
FIG. 1*a* shows a more detailed view of the one of the MYLAR® strips of FIG. 1.

FIG. 1 shows a rotating and translating process for a continuous process gapless tubular printing blanket. In this regard, the term "continuous process" indicates that the process creates a continuous tubular blanket of undetermined axial length.

FIG. 1 shows an apparatus 1 in accordance with a first embodiment of the present invention. The apparatus 1 includes a first station 100 for creating a base sleeve for the continuous process tubular printing blanket, a second station 200 for creating a compressible layer, a reinforcing layer, and a print layer, a third station 300 for applying curing tape, a fourth station 400 for curing the continuous process tubular blanket, and a fifth station 500 for removing the curing tape and grinding the surface of the blanket to provide a seamless print layer.

Figure 1C:
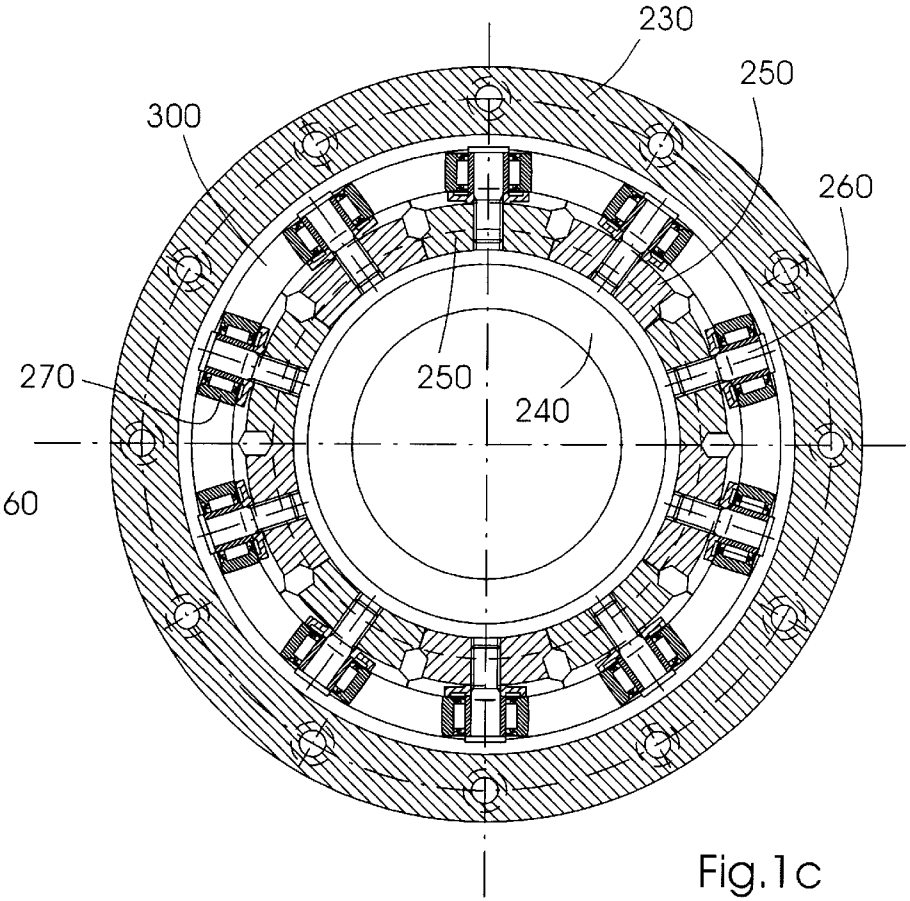
FIGS. 1*b* and 1*c* show a more detailed view of the rotating and translating transport apparatus of FIG. 1.
Figure 1B:
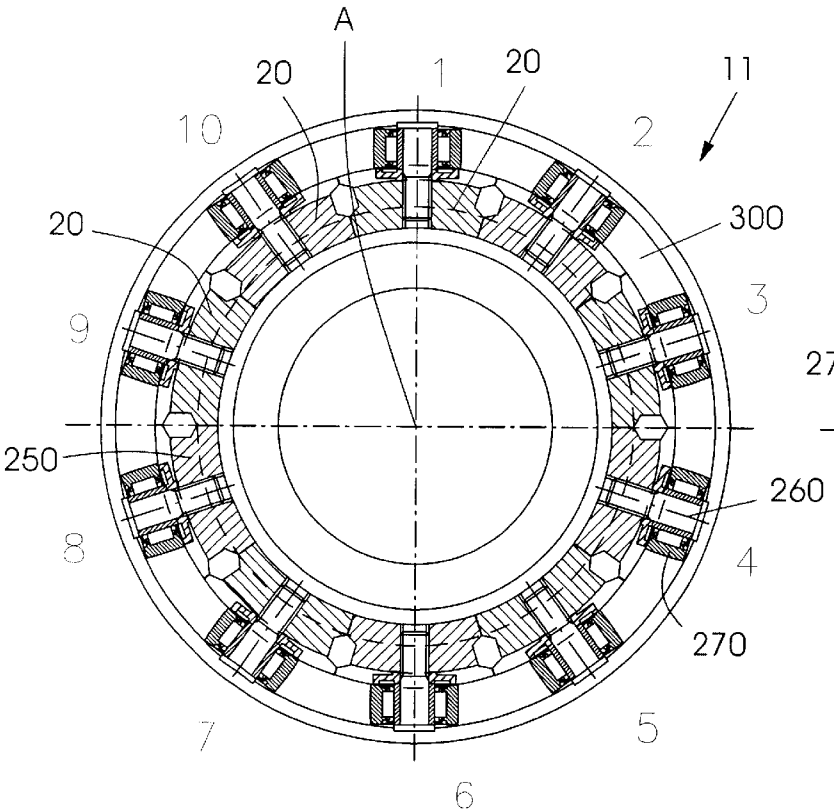

Referring to FIGS. 1, 1*b*, and 1*c*, a rotating cylindrical transport apparatus 11 includes a plurality of surface segments 20, which are shown as numbered 1 through 10 about the circumference of a rotating core 240. The segments 20, which include guiding elements 260, 270, slide translationally (i.e. axially) relative to the rotational axis A on axially extending guide tracks (not shown) to move the blanket sleeve through stations 100 through 500 as the transport apparatus 11 rotates about axis A. The movement of the segments 20 on said guide tracks is driven by the movement of the guiding elements 260, 270 within an helically extending groove (or surface guide) 300 in a bushing 230 which surrounds the rotating core 240 at one end.

In station 100, two strips of metal tape 30 and 31 are wound around the segments 20 of transport apparatus 11 as the apparatus 11 rotates. The two strips of metal are offset by ½ strip width so that they are partially overlapping. As the strips 30, 31 are wound around the apparatus 11 they are joined together by an adhesive 32 to form a metal sleeve 33. In this manner, as the segments 20 rotate about the axis A and move translationally (or axially), the workpiece, which at this point in the process comprises the metal sleeve 33 formed by the metal tape, is continuously rotated and moved from station 100 to station 200.

Figure 1D:
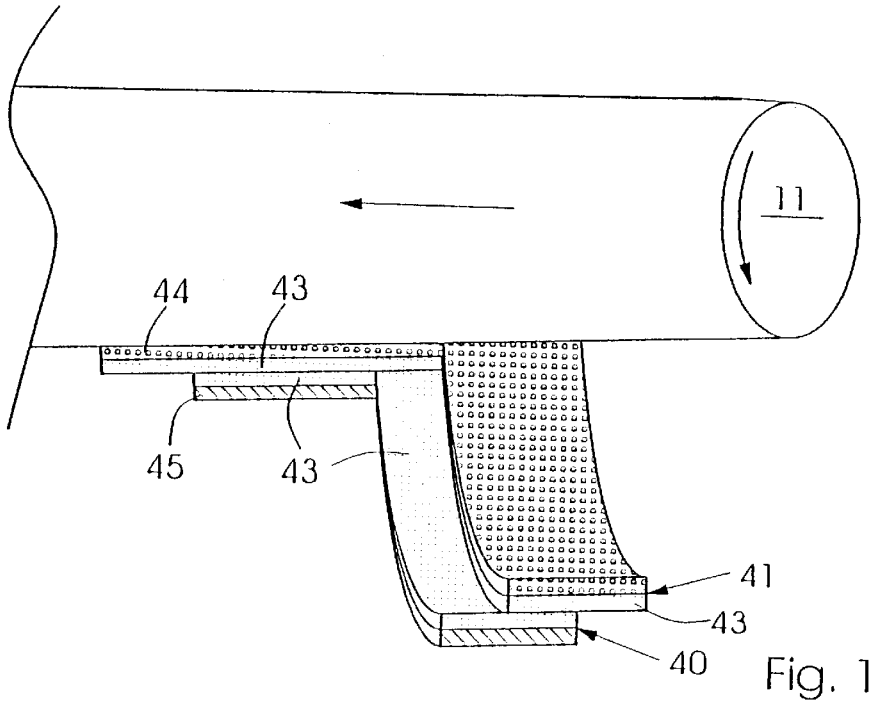
FIG. 1*d* shows a more detailed view of a station 200 wherein the application of strip 41 is delayed relative to the application of strip 40.
Figure 1E:
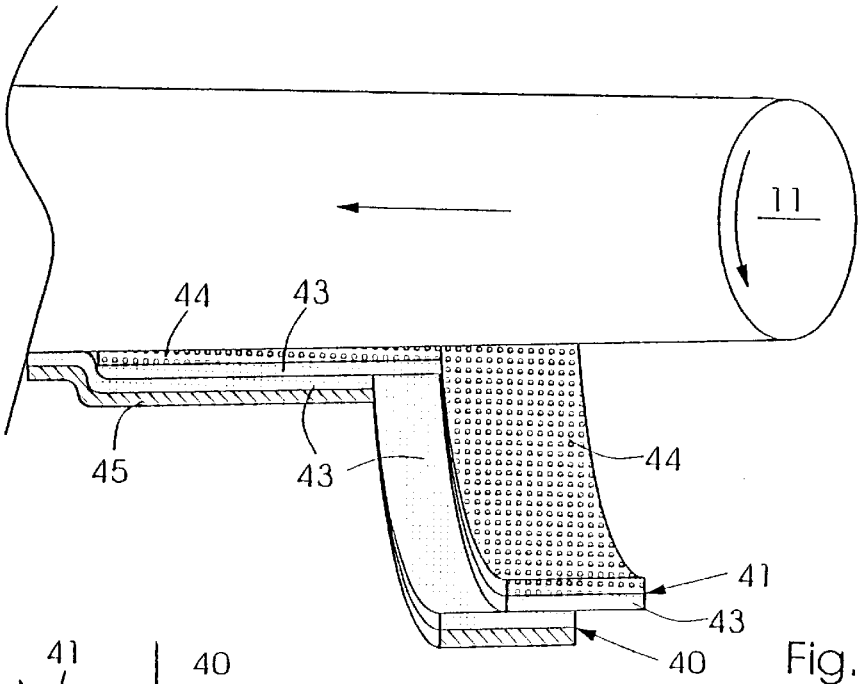
FIG. 1*e* shows a more detailed view of a station 200 wherein the strips 40 and 41 are applied at the same time.
Figure 1F:
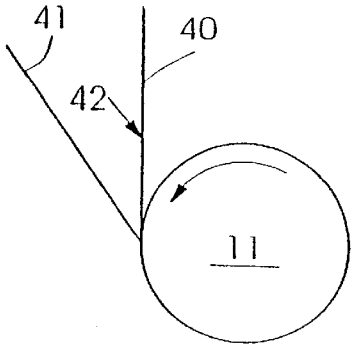
FIG. 1*f* shows a side view of FIGS. 1*d* and 1*e*.

In station 200, an inner compressible layer 44, an intermediate reinforcing layer 43, and a print layer 45 are applied over the metal sleeve 33. In station 200, two strips 40 and 41 are wound around the metal sleeve 33. The two strips are offset by ½ strip width so that they are partially overlapping. As the strips 40, 41 are wound around the sleeve 33 they are joined together by an adhesive 42 applied to one or both of the strips 40 and 41. In FIG. 1*f*, the adhesive 42 is illustrated as applied to the outer surface of strip 40.

Strip 40 is a plastic strip 43 (preferably MYLAR®) with a compressible layer 44 bonded to its inner surface. Strip 41 is a plastic strip 43 (preferably MYLAR®) with a print layer 45 bonded to its outer surface. As the strips 40 and 41 are wound around the metal sleeve 33, strip 40 is the innermost strip so that the compressible rubber layer 44 is adjacent to the metal sleeve. FIG. 1*e* shows the resulting layer structure when both strips are applied to the cylinder at the same time, and FIG. 1*d* shows the resulting structure when the application of the outermost strip 41 is delayed relative to the application of the innermost strip 40. In any event, as the segments 20 with the metal sleeve rotate about the axis A and move translationally (or axially), the metal sleeve with the compressible, reinforcing, and print layers formed thereon is continuously moved from station 200 to station 300. The adhesive may be any suitable adhesive known in the art. Preferably, the adhesive is a mixture of Chemlok 205 and Chemlok 220.

In station 300, two strips of curing tape 50 and 51 are wound around the print layer 45 as the work piece rotates. The two strips of curing tape are offset by ½ strip width so that they are partially overlapping. In this manner, as the segments 20 rotate about the axis A and move translationally (or axially), the workpiece, which now comprises the metal sleeve with the compressible, reinforcing, and print layers, and curing tape, is continuously moved from station 300 to station 400.

In station 400, the metal sleeve with the compressible, reinforcing, and print layers, and curing tape is cured, for example, by applying heat. As the segments 20 rotate about the axis A and move translationally (or axially), the metal sleeve with the compressible, reinforcing, and print layers, and curing tape is continuously moved from station 400 to station 500. In station 500, as the segments 20 rotate about the axis A and move translationally (as described above), the curing tape is removed, and the print layer 45 is ground with a stone wheel 501 to provide a smooth printing surface. In station 600, the metal sleeve with the compressible, reinforcing, and print layers is cut with a cutting device (such as a cutting wheel and anvil) to form a gapless tubular printing blanket of a desired length.

In addition, eddy current or capacitance probes may be provided at the end of section 100 in order to continuously monitor the inner diameter of the sleeve. The curing tape may be removed manually or automatically. In accordance with a preferred embodiment, the curing tape is scraped off of the work piece using a stationary blade 502.

Figure 2:
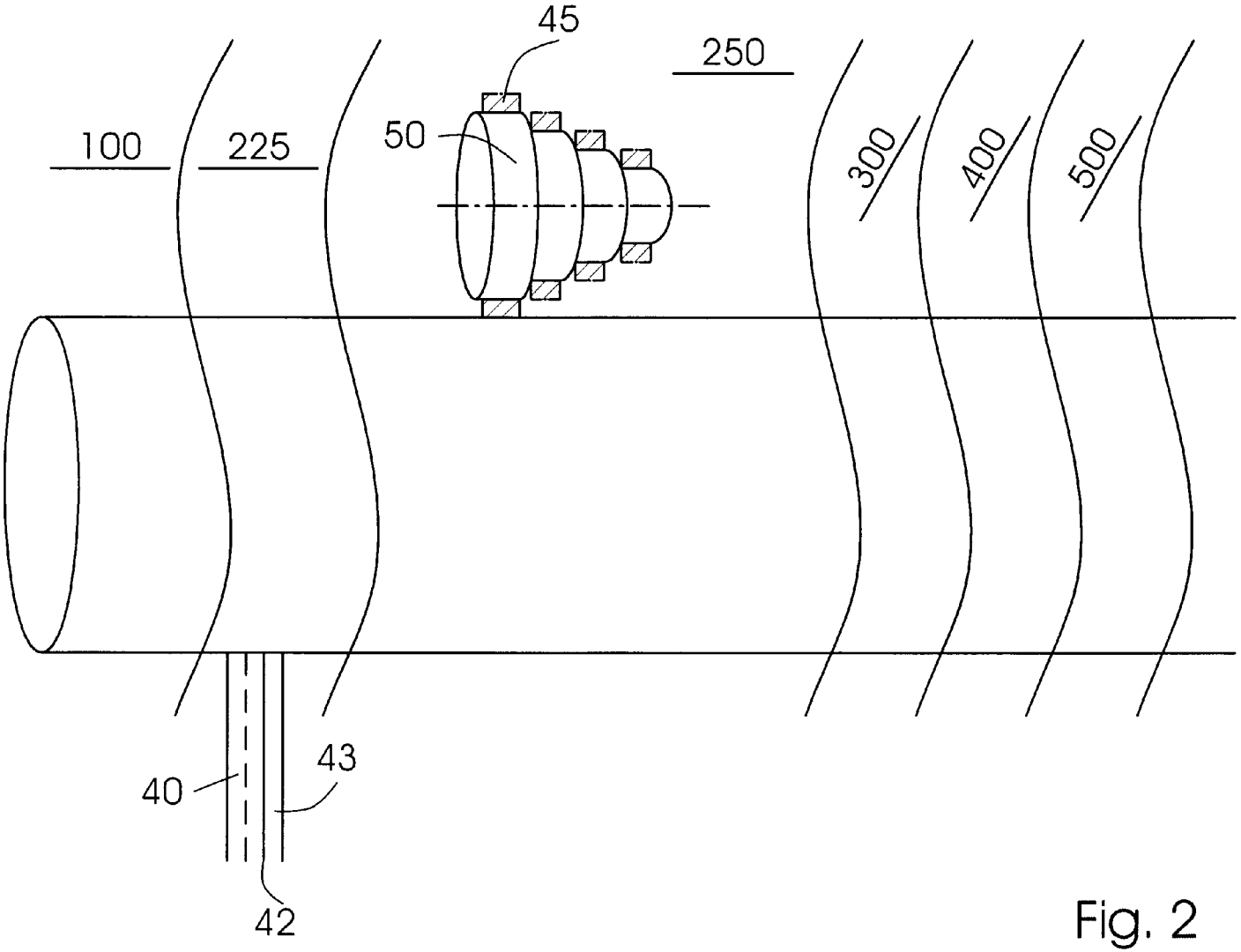
FIG. 2 shows a rotating and translating process for preparing a continuous gapless tubular printing blanket in accordance with another embodiment of the present invention utilizing MYLAR® strips coated on one side a compressible layer to provide a compressible and reinforcing layer, and a stepped cement coating device for applying a print layer.

FIG. 2 shows an alternative embodiment of the present invention, with similar components bearing like reference numerals to FIG. 1. The process according to the embodiment of FIG. 2 is identical to the process according to FIG. 1 except that station 200 of FIG. 1 is replaced with stations 225 and 250 in FIG. 2.

Figure 2A:
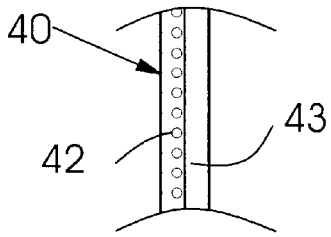
FIG. 2*a* shows a more detailed view of the one of the MYLAR® strips coated on one side with a compressible layer.

Referring to FIGS. 2 and 2*a,* in station 225, an inner compressible layer 44 and an intermediate reinforcing layer 43 are applied over the metal sleeve 33. Two strips 40 and 41 are wound around the metal sleeve 33. The two strips are offset by ½ strip width so that they are partially overlapping. As the strips are wound around the workpiece they are joined together by an adhesive 42. Each of strips 40 and 41 is a plastic strip 43 (preferably made of MYLAR®), and strip 40 has a compressible layer 44 bonded to its inner surface (FIG. 2*a*). As the strips 40 and 41 are wound around the metal sleeve 33, the compressible layer 44 is adjacent to the metal sleeve. In this manner, as the segments 20 with the metal sleeve rotate about the axis A and move translationally (or axially), the metal sleeve 33 with the compressible and reinforcing layers formed thereon is continuously moved from station 225 to station 250.

In station 250, a printing layer 45 is applied over the reinforcing layer 43 in the following manner. A stepped cement coating device 50 comprises a rotating cylindrical body having a stepped outer surface such that the diameter 51 of the cylinder gradually decreases from a first end of the cylinder (adjacent to station 225) to a second end of the cylinder (adjacent to station 300). Cement 45 is applied in liquid form onto the stepped outer surface, and is applied to the workpiece as the workpiece and coating device rotate. Preferably, the work piece is partially heated during station 250 to promote solidification of the cement. Referring to FIG. 2*c,* a plurality of metering blades 52 may be used to apply the cement to the outer surface of the coating device 50 with a desired thickness. Other methods of applying the cement with a desired thickness may alternately be employed, including, for example, using a cylindrical body with a complementary stepped outer surface. As the heated workpiece moves rotationally and translationally through station 250, a printing layer 45 gradually builds up over the reinforcing layer as it passes the coating device 50 . In this manner, a continuous and seamless printing layer is applied. It should be noted that while a stepped coating device with a stepped outer surface is shown in FIG. 2, it is also possible to employ a tapered cement coating device 50' having a tapered outer surface as shown in FIG. 2*b.*

Figure 3:
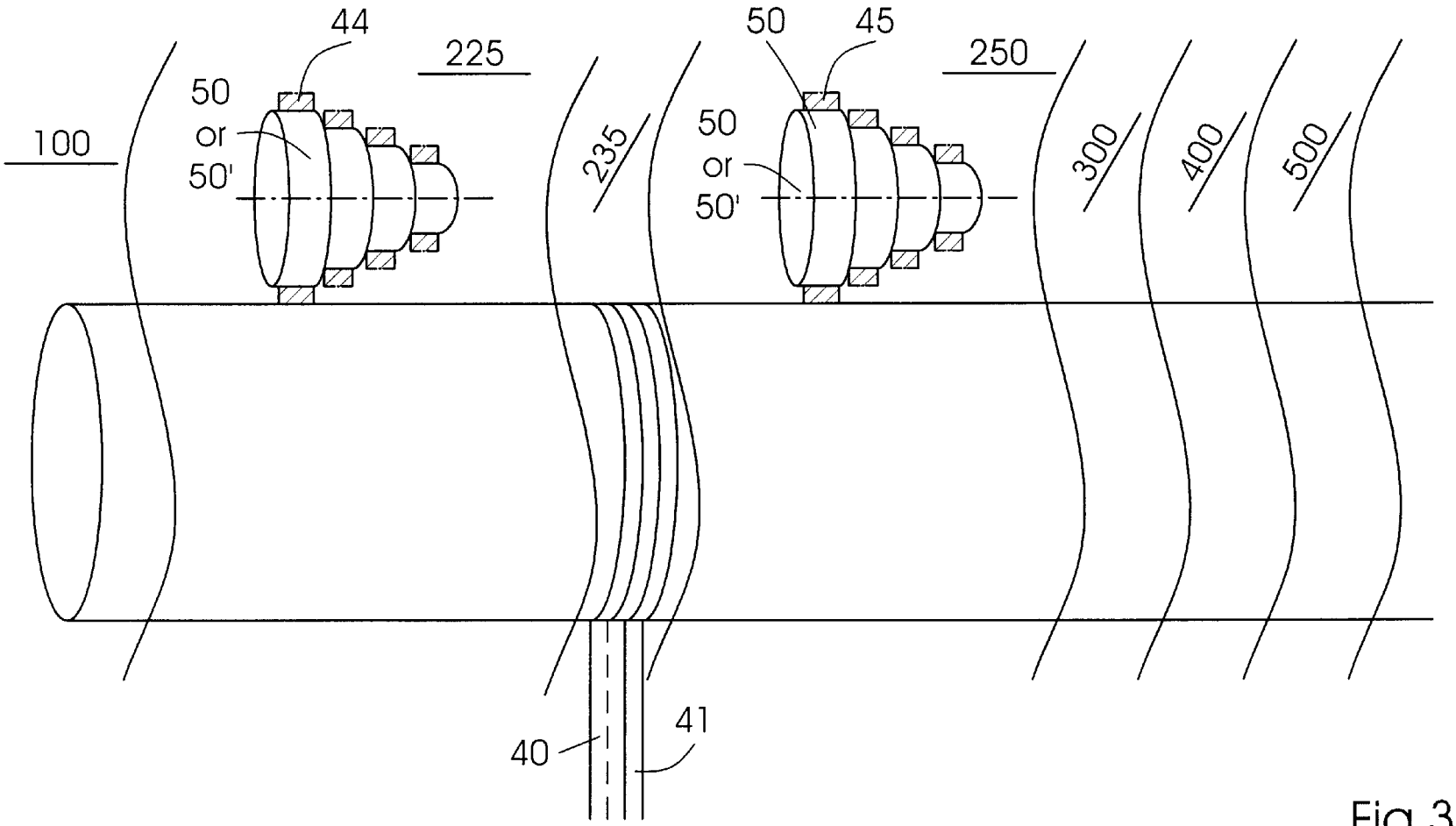
FIG. 3 shows a rotating and translating process for preparing a continuous gapless tubular printing blanket in accordance with another embodiment of the invention utilizing a stepped cement coating device to provide a compressible layer, MYLAR® strips to provide a reinforcing layer, and stepped cement coating device to provide a printing layer.

FIG. 3 shows an alternative embodiment of the present invention, with similar components bearing like reference numerals to FIG. 1. The process according to the embodiment of FIG. 3 is identical to the process according to FIG. 1 except that station 200 of FIG. 1 is replaced with stations 225, 235, and 250 in FIG. 3. Preferably, the work piece is heated during stations 100, 225, 235, 250, and 400 to promote binding between the layers of the workpiece.

Figure 2B:
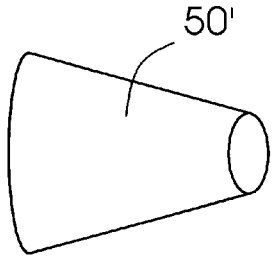
FIG. 2*b* shows a tapered cement coating device.
Figure 2C:
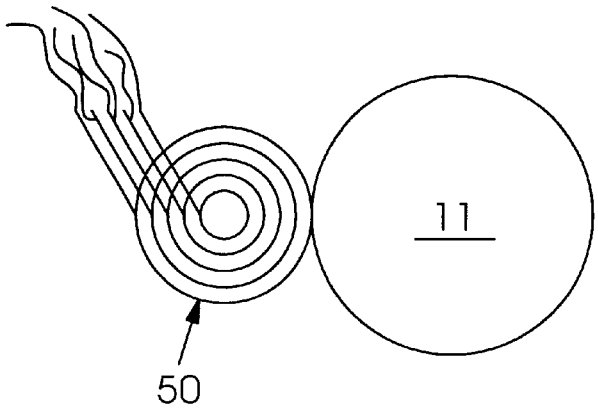
FIG. 2*c* shows a side view of the coating device of FIG. 2*a*.

Referring to FIG. 3, in station 225, an inner compressible layer 43 is applied over the metal sleeve using a stepped or tapered rubber cement coating device 50 (or 50'), as described in FIGS. 2*b* and 2*a.* Preferably, the elastomeric cement applied with the coating device contains microspheres, a blowing agent, a foaming agent, or other additive materials known in the art to form voids in the layer 43 and thereby make the layer of elastomer compressible.

In station 235, two plastic strips 40 and 41 are wound around the compressible layer 43. The two strips are offset by ½ strip width so that they are partially overlapping. As the strips are wound around the workpiece they are joined together by an adhesive 42 to form the reinforcing layer. In this manner, as the segments 20 with the metal sleeve rotate about the axis A and move translationally (or axially), the metal sleeve with the compressible and reinforcing layers formed thereon is continuously moved from station 235 to station 250. In station 250 a printing layer 45 is applied over the reinforcing layer 43 in the same manner described above in FIGS. 2 and 2*b.*

In accordance with yet other embodiments of the rotating and translating process in accordance with the invention, the reinforcing layer may be applied as plastic in liquid form via a stepped or tapered cement coating device.

Figure 4:
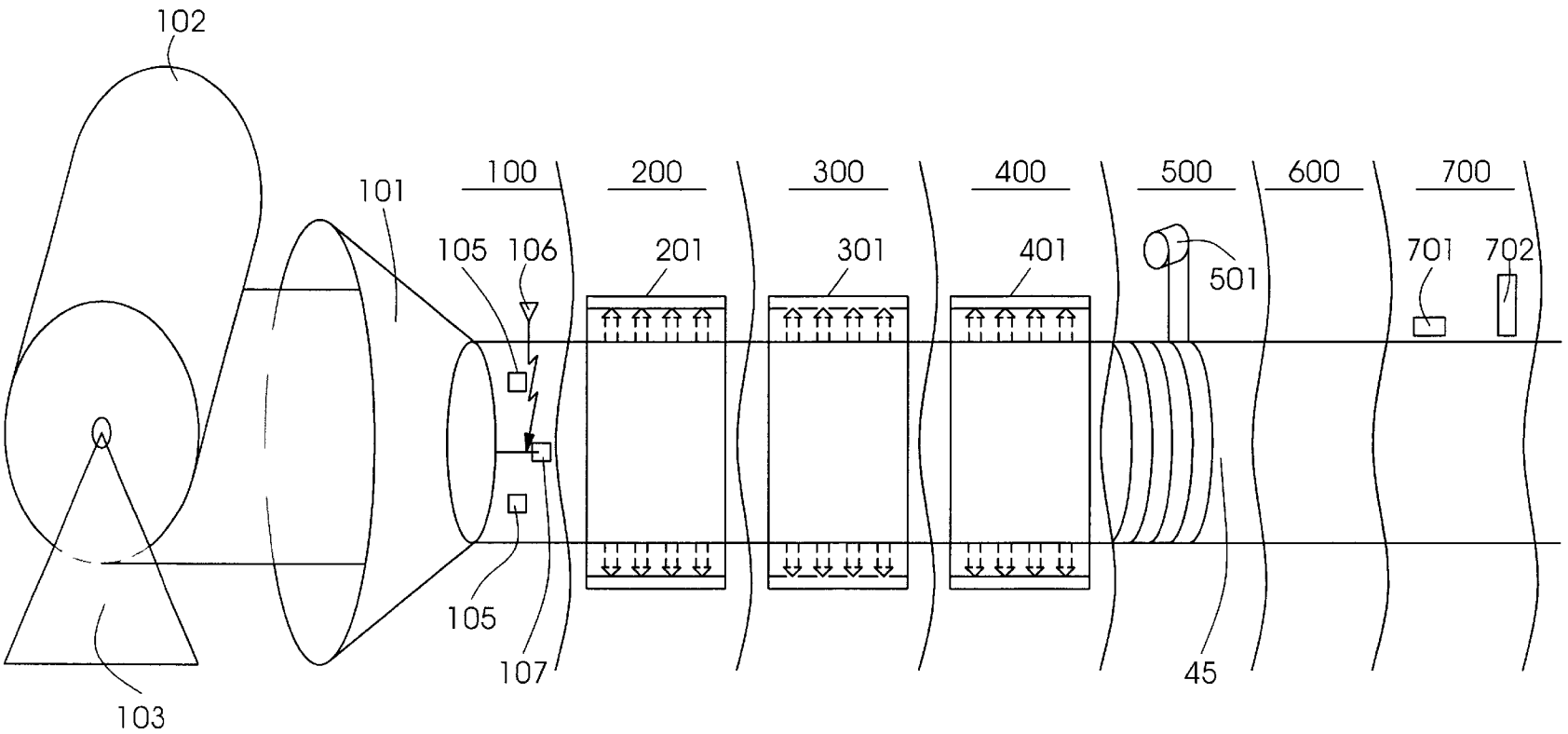
FIG. 4 shows a non-rotating and translating process for preparing a continuous gapless tubular printing blanket in accordance with another embodiment of the invention utilizing cross head extruders to apply a compressible layer, a reinforcing layer and a print layer.

FIG. 4 shows a non-rotating and translating process for preparing a continuous gapless tubular printing blanket in accordance with another embodiment of the invention. In accordance with this process, the work piece moves translationally (i.e. axially), but does not rotate, as it passes through stations 100 (formation of the metal sleeve), 200 (formation of the compressible layer), 300 (formation of the reinforcing layer), 400 (formation of the print layer), 500 (application of curing tape), 600 (curing), and 700 ( removal of curing tape and grinding). Preferably, the work piece is heated during stations 100, 200, 300, 400, and 600 to promote binding between the layers of the workpiece.

A conveying device having a support platform configured to support a tubular moves the work piece translationally (but not rotationally) through stations 100 through 700.

Figure 4A:
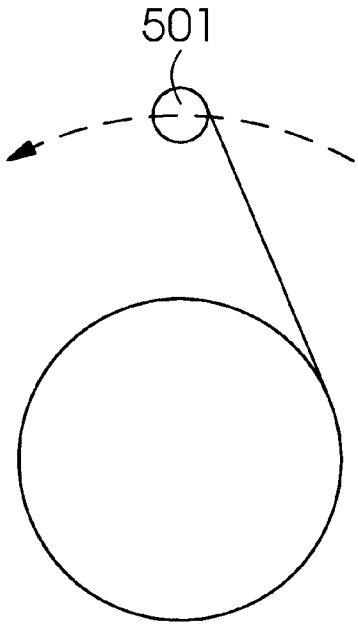
FIG. 4*a* shows a winding apparatus of FIG. 4 in greater detail.
Figure 4B:
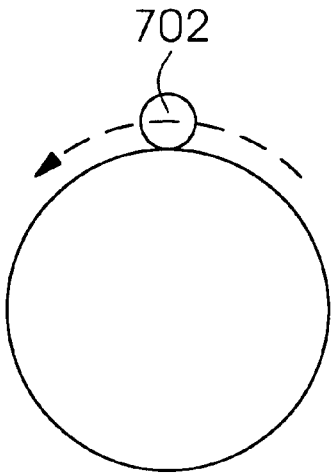
FIG. 4*b* shows a grinding apparatus of FIG. 4 in greater detail.
Figure 4C:
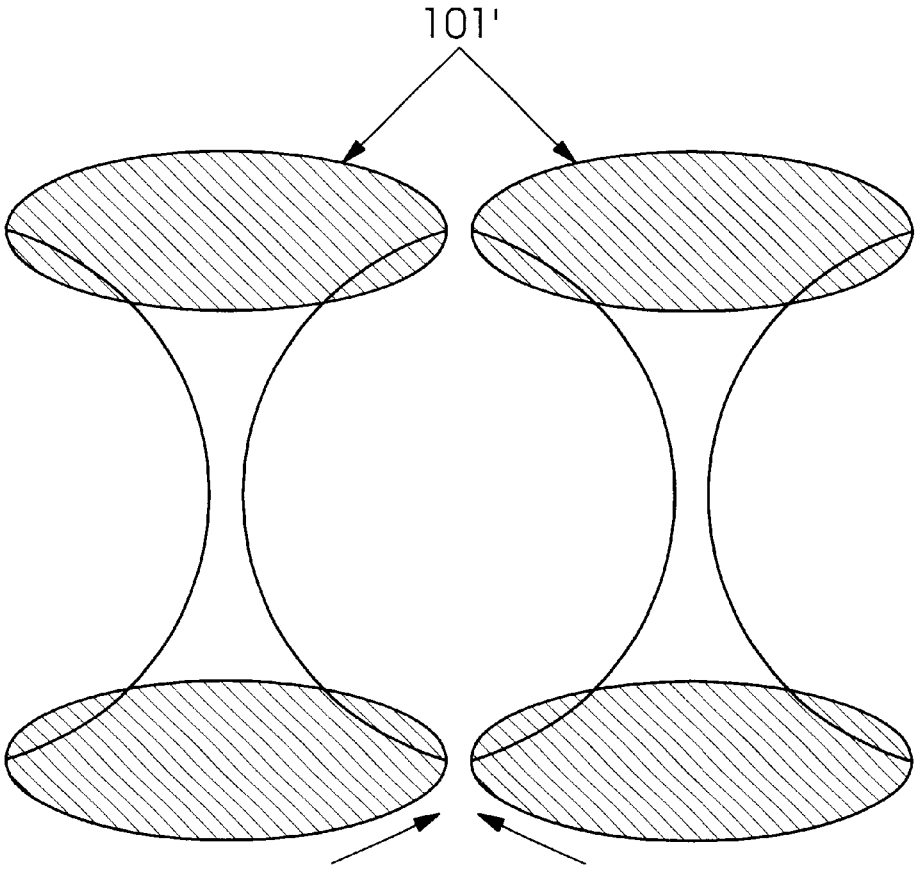
FIG. 4*c* shows a pair of concave shaped former rollers.

Station 100 includes a roll of sheet metal 102 rotatingly supported in a roll stand 102. Sheet metal 102 is fed into a conical former 101 which shapes the flat sheet of metal around the support platform into a cylinder and then joins the ends of the cylinder using holding wheels 105, a laser welder 106, and plummishing (i.e. cold working) rollers 107 to form a continuous metal sleeve. The support platform continuously moves the work piece (which at this station of the process comprises the metal sleeve 33) to station 200. Alternatively, the conical former 101 can be replaced with a pair of concave shaped former rollers 101' as shown in FIG. 4*c,* and the sheet of metal 102 fed through the space between the former rollers 101' to shape the flat sheet of metal into a cylinder.

Stations 200, 300, and 400 include respective cross head extruders 201, 301, and 401. Cross-head extruder 201 applies an elastomeric material including microperes (or a blowing agent, a foaming agent or other additives known in the art to form voids in elastomeric materials) over the metal sleeve 33 as the work piece passes through station 200 to station 300, thereby forming a gapless and seamless compressible layer. Cross-head extruder 301 applies a plastic material such as MYLAR® over the compressible layer as the work piece passes though station 300, thereby forming a gapless and seamless reinforcing layer. Finally, cross-head extruder 401 applies an elastomeric material over the reinforcing layer as the work piece passes though station 300, thereby forming a gapless and seamless printing layer.

In station 500, a orbital winding device 501 applies two strips of curing tape 50 and 51 around the print layer 45 as the work piece passes through station 500. The two strips of curing tape are offset by ½ strip width so that they are partially overlapping. The work piece is then cured as it passes through station 600. The curing tape is then removed and the printing layer is ground by an orbital grinding device 702 as it passes through station 700. The winding device 501 and grinding device 702 are referred to as orbital because they rotate around the work piece as the work piece moves translationally as shown in FIGS. 4*a* and 4*b*. In addition, eddy current or capacitance probes may be provided at the end of section 100 in order to continuously monitor the inner diameter of the sleeve. The curing tape may be removed manually or automatically. In accordance with a preferred embodiment, the curing tape is removed from the work piece using an axially extending stationary blade 701 as shown in FIG. 4.

Figure 5:
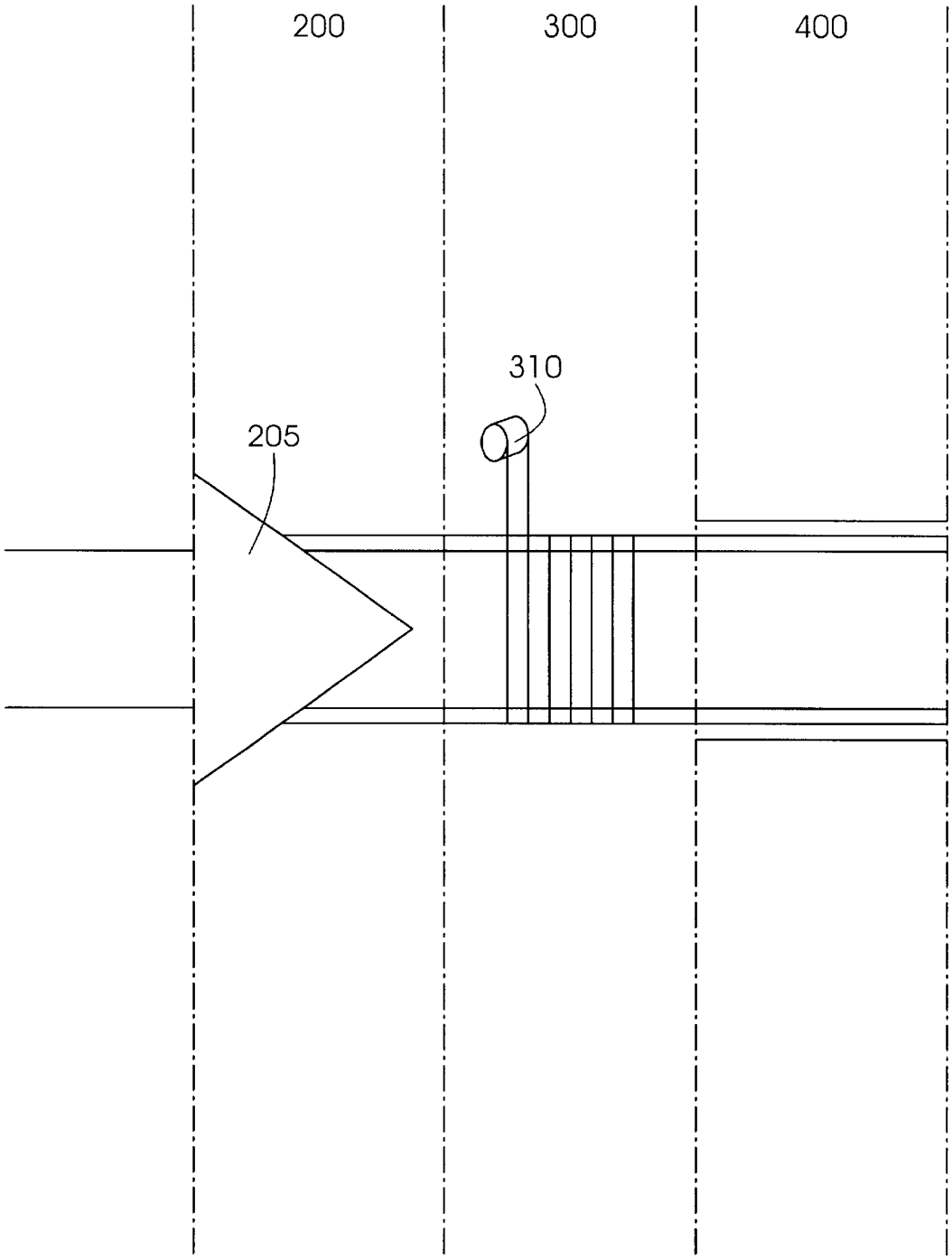
FIG. 5 shows a non-rotating and translating process for preparing a continuous gapless tubular printing blanket in accordance with another embodiment of the invention utilizing cross head extruders to apply a compressible layer and a print layer, and a winding apparatus to apply a reinforcing layer.

FIG. 5 shows a non-rotating and translating process for preparing a continuous gapless tubular printing blanket in accordance with another embodiment of the invention, with similar components bearing the same reference numerals as FIG. 4. In FIG. 5, stations 100, 400, 500, 600, and 700 are identical to FIG. 4. However, in accordance with the embodiment of FIG. 5, station 200 comprises a roll of compressible elastomeric material rotatingly supported on a roll stand and a conical former (schematically identified in FIG. 5 as component 205) which shapes a flat sheet of compressible elastomeric material into a cylinder and then joins the ends of the cylinder with adhesive either as a but or overlap seam. The roll of compressible elastomeric material, roll stand and conical former of FIG. 5 operate in a similar manner to roll 102, roll stand 103, and conical former 101 of FIG. 4. However, in accordance with the embodiment of FIG. 5, the ends of the flat sheet of compressible material is joined via an adhesive. Therefore, welders, holding rollers, and plumishing rollers are unnecessary. In addition, in FIG. 5, station 300 includes an orbital winding device 310 for wrapping two plastic strips 40 and 41 around the compressible layer 43. The two strips are offset by ½ strip width so that they are partially overlapping. Preferably, the work piece is heated during stations 100, 200, 300, 400, and 600 to promote binding between the layers of the workpiece.

In accordance with other embodiments of the non-rotating and translating continuous process in accordance with the present invention, one or more of the reinforcing layer (strips 40, 41) and the print layer 45 are applied as a flat sheet using a conical former in the manner described with reference to FIG. 5.

In accordance with yet another embodiment of the non-rotating and translating continuous process in accordance with the present invention, the compressible, reinforcing, and print layers may be applied in station 300 using an orbital winding device which wraps two partially overlapping plastic strips 43 around the sleeve, wherein the inner plastic strip has a compressible rubber layer 44 bonded to its inner surface and wherein the outer plastic strip has a print layer 45 bonded to its outer surface. In this embodiment, stations 200 and 400 would be omitted from FIG. 5.

In accordance with yet another embodiment of the non-rotating and translating continuous process in accordance with the present invention, the compressible and reinforcing layers may be applied in station 300 using a single orbital winding device which wraps two partially overlapping plastic strips 43 around the sleeve, wherein the inner plastic strip has a compressible rubber layer 44 bonded to its inner surface. In this embodiment, station 200 would be omitted from FIG. 5.

In accordance with yet another embodiment of the non-rotating and translating continuous process in accordance with the present invention, the reinforcing and printing layers may be applied in station 300 using an orbital winding device which wraps two partially overlapping plastic strips 43 around the sleeve, wherein the outer plastic strip has a print layer 45 bonded to its outer surface. In this embodiment, station 400 would be omitted from FIG. 5.

In other embodiments of the non-rotating and translating continuous process in accordance with the present invention, the compressible layer may be applied in station 200 using an orbital winding device which wraps a strip of compressible material around the sleeve. Similarly, the print layer may be applied in station 400 using an orbital winding device which wraps a strip of elastomeric print transferring material around the sleeve.

Figure 6:
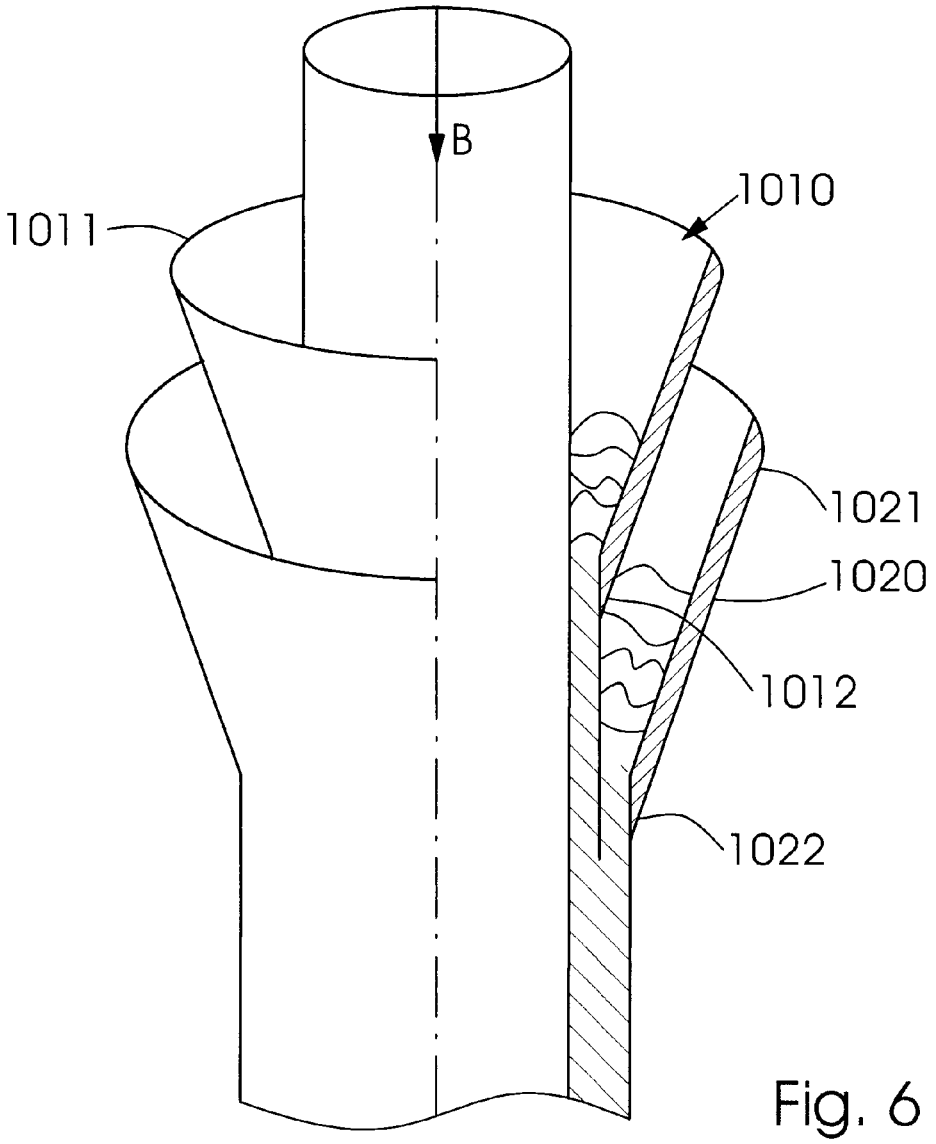
FIG. 6 shows a plurality of cone shaped rings for forming a compressible layer and a print layer in accordance with another embodiment of the non-rotating and translating process for preparing a continuous gapless tubular printing blanket.

FIG. 6 shows an apparatus 1000 which includes a pair of vertically spaced apart cone shaped elements 1010 and 1020. A heated work piece 10 moves vertically downward (as indicated by arrow B) through the center of cone shaped elements 1010 and 1020. Cone shaped elements 1010 and 1020 have respective top ends 1011 and 1021 and respective lower ends 1012 and 1022. Lower end 1022 has a diameter which is greater than lower end 1012. In operation, an elastomeric material is poured into cone shaped elements 1010 and 1020 through their respective upper ends 1011 and 1021 as the work piece moves in direction B, thereby applying the elastomeric material over the work piece in successive layers. In this regard, the speed of the movement of the work piece and the distance between ends 1012 and 1022 is selected so that the elastomeric material applied by cone 1010 has solidified prior to the application of the further elastomeric material by cone 1022. The apparatus 1000 can be used in either or both of stations 200 and 400 of FIG. 5 to apply the compressible layer and/or the print layer, provided that stations 200 through 700 are stacked vertically below station 100. It should be understood that while FIG. 6 illustrates the apparatus 1000 as including two cone shaped elements for applying two coats of elastomeric material, it is possible to provide additional cone shaped elements for applying additional coats. Preferably, the work piece is heated during stations 100, 200, 300, 400, and 600 to promote binding between the layers of the workpiece.

As used herein, the term "compressible layer" refers to an elastomeric material which has been made compressible in any manner known in the art, including for example, through the use of microspheres, blowing agents, foaming agents, or leaching. Examples of such materials are disclosed for example in U.S. Pat. Nos. 5,768,990, 5,553,541, 5,440,981, 5,429,048, 5,323,702, and 5,304,267.

As used herein, the term printing layer or elastomeric print transferring material refers to an elastomeric material which is suitable for transferring an image from a lithographic printing plate or other image carrier to web or sheet of material, with such print quality as the particular printing application requires.

Although the preferred embodiments of the continuous process lithographic printing blanket in accordance with the present invention has been illustrated herein as including a compressible layer, a reinforcing layer, and a print layer, it should be understood that, if desired for a particular application, the blanket may also include a base build-up layer between the sleeve 33 and the compressible layer 34. The build-up layer may be formed via the same methods described above for applying the compressible layer and the print layer, including, for example, the stepped or tapered rubber cement coating devices of FIGS. 2 and 2*b*, the conical former arrangments of FIG. 5, the cross-head extruders of FIG. 4, the orbital winding device of FIG. 4*a*, or the precoated strips of FIG. 1. The build-up layer may, for example, be manufactured using the same elastomeric material used for the print layer.

In addition, it should be understood that while the blanket in accordance with the present invention preferably includes a compressible, reinforcing, and print layers, it is also possible to prepare blankets with fewer or additional layers. For example, if appropriate for a particular application, a blanket in accordance with the present invention may be comprised of a sleeve and a print layer; or a sleeve, a compressible layer, and a print layer. Moreover, it should be understood that a blanket in accordance with the present invention might also include multiple compressible layers, multiple build up layers, or multiple reinforcing layers.

Although the use of partially overlapping strips is preferable because it provides a more isometric reinforcing layer, it is also possible to use a single strip of plastic to form the reinforcing layer. In such embodiments the single strip of plastic could be coated on one side with a compressible material to form a reinforcing layer and a compressible layer, be coated on one side with a elastomeric print transferring material to form a reinforcing layer and a print layers, be coated on one side with a compressible material on the other side with a elastomeric print transferring material to form a compressible layer, a reinforcing layer, and a print layer, or be uncoated to provide only a reinforcing layer.

In addition, although the reinforcing layer is preferably formed from strips of plastic 40 and 41, it is also possible to utilize partially overlapping fabric strips. In addition, in embodiments where the reinforcing layer is applied separately from the print and compressible layers, the reinforcing layer may be formed by winding fabric or plastic cords or threads around the work piece.

What is claimed is:

1. A continuous process for manufacturing a gapless tubular printing blanket comprising the steps of:

continuously forming a tubular sleeve in a sleeve forming station;

moving the tubular sleeve axially from the sleeve forming station through a print layer forming station; and continuously applying a print layer over said tubular sleeve as it passes through said print layer forming station to form a gapless tubular printing blanket of indeterminate length.

2. The continuous process according to claim 1, wherein said step of moving comprises, prior to moving said sleeve through the print layer forming station, the steps of:

moving the tubular sleeve axially from the sleeve forming station through a compressible layer forming station; and continuously applying a compressible layer over said tubular sleeve as it passes through said compressible layer forming station.

3. The continuous process according to claim 2, wherein said step of moving comprises, prior to moving said sleeve through the print layer forming station and after moving said sleeve through the compressible layer forming station, the steps of:

moving the tubular sleeve axially from the compressible layer forming station through a reinforcing layer forming, station; and continuously applying a reinforcing layer over said compressible layer as the sleeve passes through said reinforcing layer forming station.

4. The continuous process according to claim 1, wherein said continuously applying step comprises:

winding a pair of partially overlapping strips of reinforcing material around the sleeve, the pair including an inner strip and an outer strip, the inner strip having a inner surface adjacent said sleeve, the inner surface having an elastomeric compressible material bonded thereto, the outer strip having an outer surface having an elastomeric print transferring material bonded thereto.

5. The continuous process according to claim 1, wherein said continuously applying step comprises:

winding a strip of reinforcing material around the sleeve, the strip having a inner surface adjacent said sleeve and an outer surface, the inner surface having a strip of elastomeric compressible material bonded thereto, the outer surface having a strip of elastomeric print transferring material bonded thereto.

6. The continuous process according to claim 4, wherein said moving step comprises rotating said sleeve as it moves axially from the sleeve forming station through the print layer forming station.

7. The continuous process according to claim 4, wherein said reinforcing material is plastic.

8. The continuous process according to claim 4, wherein said reinforcing material is fabric.

9. The continuous process according to claim 2, wherein said continuously applying a print layer step comprises:

winding a pair of partially overlapping strips of reinforcing material around the sleeve, the pair including an inner strip and an outer strip, the outer strip having an outer surface having an elastomeric print transferring material bonded thereto.

10. The continuous process according to claim 2, wherein said continuously applying a compressible layer step comprises:

winding a pair of partially overlapping strips of reinforcing material around the sleeve, the pair including an inner strip and an outer strip, the inner strip having a inner surface adjacent said sleeve and an outer surface, the inner surface having an elastomeric compressible material bonded thereto.

11. The continuous process according to claim 3, wherein said moving step comprises moving said sleeve axially, but not rotatingly, from the sleeve forming station through the print layer forming station.

12. The continuous process according to claim 1, wherein said step of continuously applying a print layer comprises applying the print layer via a stepped or tapered cement coating device.

13. The continuous process according to claim 1, wherein said step of continuously applying a print layer comprises applying the print layer via a cross head extruder.

14. The continuous process according to claim 2, wherein said step of continuously applying a compressible layer comprises applying the compressible layer via a stepped or tapered cement coating device.

15. The continuous process according to claim 2, wherein said step of continuously applying a compressible layer comprises applying the compressible layer via a cross head extruder.

16. The continuous process according to claim 3, wherein one or more of the steps of continuously applying a print layer, continuously apply a compressible layer, and continuously applying a reinforcing layer comprises applying the layer via a cross head extruder.

17. The continuous process according to claim 3, wherein said step of continuously applying a reinforcing layer comprises winding reinforcing material around the compressible layer.

18. The continuous process according to claim 3, wherein said reinforcing material is selected from the group consisting of a strip of plastic, a strip of fabric, a plastic cord, a fabric cord, a plastic thread, and a fabric thread.

19. The continuous process according to claim 3, wherein one or more of the steps of continuously forming a tubular sleeve, continuously applying a print layer, continuously applying a compressible layer, and continuously applying a reinforcing layer, comprises utilizing a conical former.

20. The continuous process according to claim 3, wherein one or more of the steps of continuously applying a print layer and continuously applying a compressible layer comprises passing the sleeve through a plurality of vertically spaced apart cones, wherein each cone has, contained therein, one of an elastomeric compressible material and an elastomeric print transferring material in liquid form, and wherein each of said cones has a diameter which is greater than a diameter of an cone located above and adjacent to said each cone.

* * * * *